US008789340B2

(12) United States Patent
Dixon et al.

(10) Patent No.: US 8,789,340 B2
(45) Date of Patent: Jul. 29, 2014

(54) SURFACE UNDERLAYMENT

(71) Applicant: Track Renovations, Inc., Uniontown, KS (US)

(72) Inventors: Michael L. Dixon, Uniontown, KS (US); Richard L. Dixon, Frontenac, KS (US); Benjaman M. Dixon, Uniontown, KS (US)

(73) Assignee: Track Renovations, Inc., Pittsburg, KS (US)

( * ) Notice: Subject to any disclaimer, the term of this patent is extended or adjusted under 35 U.S.C. 154(b) by 0 days.

(21) Appl. No.: 13/839,230

(22) Filed: Mar. 15, 2013

(65) Prior Publication Data

US 2014/0000202 A1 Jan. 2, 2014

Related U.S. Application Data

(60) Provisional application No. 61/666,530, filed on Jun. 29, 2012.

(51) Int. Cl.
*E04B 5/00* (2006.01)

(52) U.S. Cl.
USPC ..... 52/745.19; 52/745.05; 52/746.1; 52/403.1; 52/480

(58) Field of Classification Search
USPC ..... 52/384–388, 390–392, 403.1, 408–409, 52/741.41, 746.1, 747.11, 404.1, 480, 144, 52/145, 741.4, 745.05, 745.19; 428/47–49, 44, 95; 156/62.2, 71; 181/285–286, 290, 294
See application file for complete search history.

(56) References Cited

U.S. PATENT DOCUMENTS

| | | | | |
|---|---|---|---|---|
| 4,114,334 | A * | 9/1978 | Thoren | 52/302.3 |
| 4,824,498 | A * | 4/1989 | Goodwin et al. | 156/71 |
| 6,599,599 | B1 * | 7/2003 | Buckwater et al. | 428/40.1 |
| 7,591,967 | B2 * | 9/2009 | Palermo et al. | 264/34 |
| 7,886,488 | B2 * | 2/2011 | Payne et al. | 52/144 |
| 2003/0219582 | A1 | 11/2003 | Ramesh et al. | |
| 2005/0255308 | A1 * | 11/2005 | Gregg et al. | 428/312.4 |
| 2007/0062139 | A1 | 3/2007 | Jones et al. | |
| 2008/0124530 | A1 | 5/2008 | Paradis et al. | |
| 2010/0284740 | A1 | 11/2010 | Sawyer et al. | |
| 2011/0073239 | A1 * | 3/2011 | Manning et al. | 156/62.2 |
| 2012/0135220 | A1 | 5/2012 | Keane | |
| 2012/0308795 | A1 * | 12/2012 | Hauber et al. | 428/218 |

OTHER PUBLICATIONS

International Search Report and Written Opinion from PCT Application No. PCT/US13/048732 entitled Surface Underlayment (Dated Sep. 2, 2013).

* cited by examiner

*Primary Examiner* — Jeanette E. Chapman
(74) *Attorney, Agent, or Firm* — Hovey Williams LLP

(57) ABSTRACT

A flooring system is constructed on a base. The flooring system includes a permeable barrier layer, a porous underlayment, an impermeable sealing layer, and a flooring. The barrier layer is configured to cover the base. The underlayment overlies the barrier layer, with the barrier layer preventing binding of the underlayment to the base while permitting fluid to pass between the base and underlayment. The underlayment presents a top face, and the sealing layer coats the top face of the underlayment. The flooring is fixed relative to the top face of the underlayment.

17 Claims, 3 Drawing Sheets

SURFACE UNDERLAYMENT

CROSS-REFERENCE TO RELATED APPLICATIONS

This application claims the benefit of U.S. Provisional Application No. 61/666,530, filed Jun. 29, 2012, which is incorporated herein by reference in its entirety.

BACKGROUND OF THE INVENTION

1. Field of the Invention

The present invention relates generally to a flooring system and base. More particularly, the present invention concerns a flooring system including a surface underlayment configured to disperse or direct vapor and to provide a buffer against propagation of defects from a base on which the underlayment is supported.

2. Discussion of the Prior Art

Those of ordinary skill in the art will appreciate that flooring surfaces are often subject to sub-optimal conditions arising as a result of flaws in the base upon which the surfaces are built. For instance, cracking, alligatoring, deterioration, and/or other defects in a base caused from improper original construction and/or as a result of environmental effects such as high humidity, extreme temperature fluctuations, poor drainage, et cetera can detrimentally affect the quality of a flooring surface. In other cases, vapor leakage through the base can affect the flooring surface.

SUMMARY

According to one aspect of the present invention, a method of constructing a flooring system on a base is provided. The construction method comprises the steps of: (a) lining the base with a permeable barrier layer; (b) applying a porous underlayment on the barrier layer, with the barrier layer serving to prevent binding of the underlayment to the base while permitting fluid to pass between the base and underlayment; (c) sealing the top face of the underlayment; and (d) fixing a flooring relative to the top face of the underlayment.

According to another aspect of the present invention, a flooring system constructed on a base is provided. The flooring system comprises a permeable barrier layer, a porous underlayment, an impermeable sealing layer, and a flooring. The permeable barrier layer is configured to cover the base. The porous underlayment overlies the barrier layer, with the barrier layer preventing binding of the underlayment to the base while permitting fluid to pass between the base and underlayment. The underlayment presents a top face, and the impermeable sealing layer coats the top face of the underlayment. The flooring is fixed relative to the top face of the underlayment.

According to another aspect of the present invention, a method of constructing a flooring system on a base is provided. The construction method comprises the steps of: (a) applying a porous underlayment on the base, wherein the underlayment comprises a compound including elastic material and inelastic particles; (b) sealing the top and side faces of the underlayment; and (c) fixing a flooring relative to the top face of the underlayment.

According to another aspect of the present invention, a flooring system constructed on a base is provided. The flooring system comprises a porous underlayment, an impermeable sealing layer, and a flooring. The porous underlayment overlies and is adhered to the base, with the underlayment comprising a compound that includes an elastic material and inelastic particles. The underlayment presents a top face and a perimetrical side face. The impermeable sealing layer coats the top and side faces of the underlayment. The flooring is fixed relative to the top face of the underlayment.

This summary is provided to introduce a selection of concepts in a simplified form. These concepts are further described below in the detailed description of the preferred embodiments. This summary is not intended to identify key features or essential features of the claimed subject matter, nor is it intended to be used to limit the scope of the claimed subject matter.

Various other aspects and advantages of the present invention will be apparent from the following detailed description of the preferred embodiments and the accompanying drawing figures.

BRIEF DESCRIPTION OF THE DRAWING FIGURES

Preferred embodiments of the present invention are described in detail below with reference to the attached drawing figures, wherein.

Figure 4:
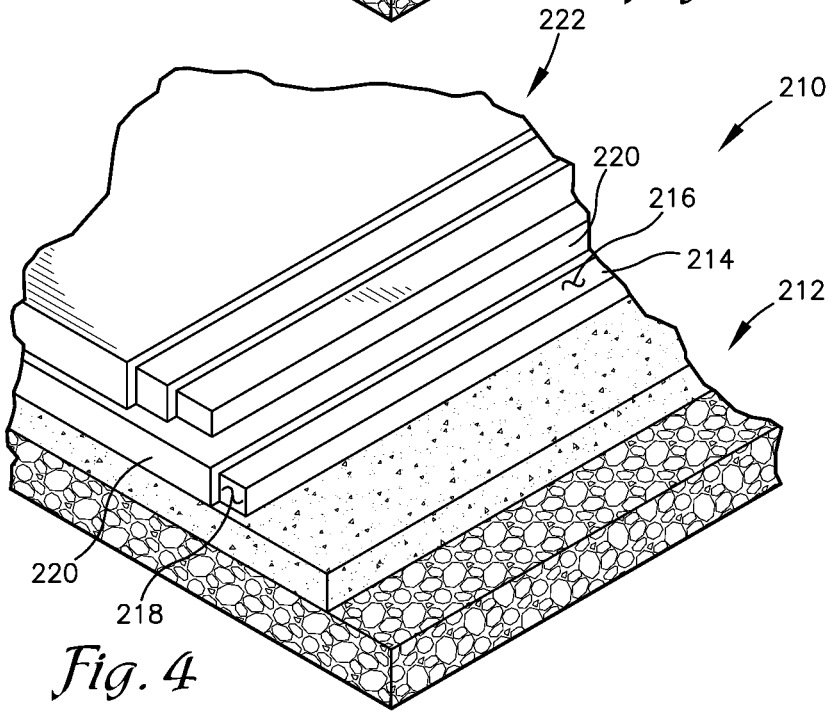
Figure 5:
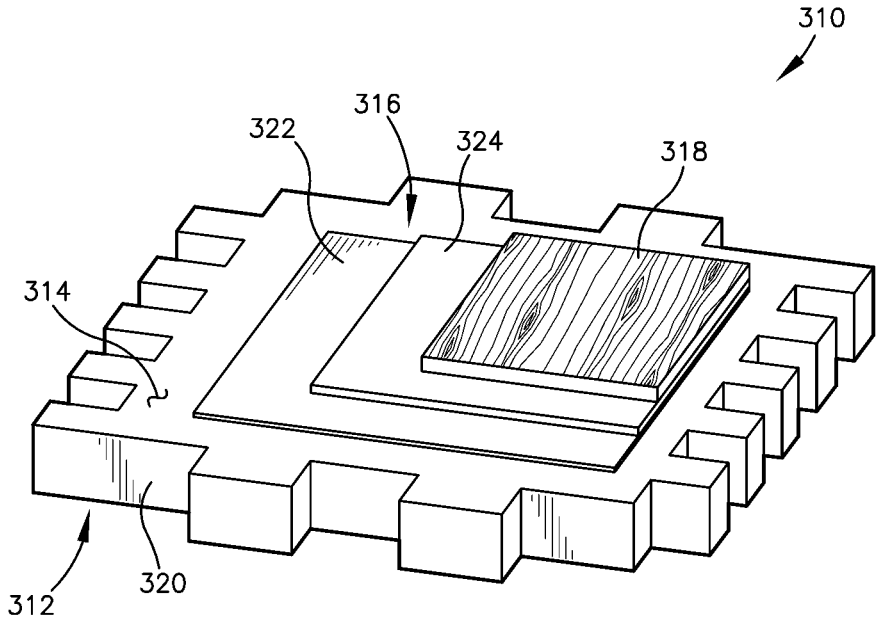

FIG. 4 is a perspective view of a flooring system and base constructed in accordance with a third preferred embodiment of the present invention, wherein the underlayment is sealed on the sides to prevent side venting of vapor and wherein neither a barrier layer nor a collar is provided; and FIG. 5 is a perspective view of a flooring system constructed in accordance with a fourth preferred embodiment of the present invention, wherein the underlayment is in the form of an interlocking tile and wherein the flooring comprises wood flooring.

DETAILED DESCRIPTION OF THE PREFERRED EMBODIMENTS

The present invention is susceptible of embodiment in many different forms. While the drawings illustrate, and the specification describes, certain preferred embodiments of the invention, it is to be understood that such disclosure is by way of example only. There is no intent to limit the principles of the present invention to the particular disclosed embodiments.

Figure 1:
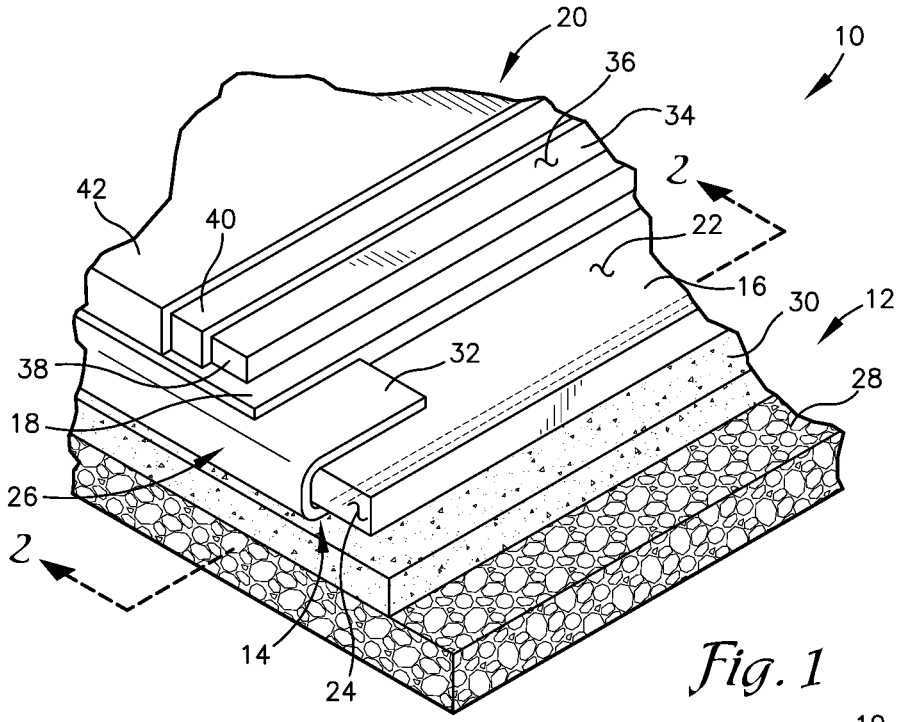
FIG. 1 is a perspective view of a flooring system and base constructed in accordance with a first preferred embodiment of the present invention, wherein the underlayment is configured to allow side venting of vapor and wherein the permeable barrier layer placed over the base additionally forms a collar over the side face of the underlayment.
Figure 2:
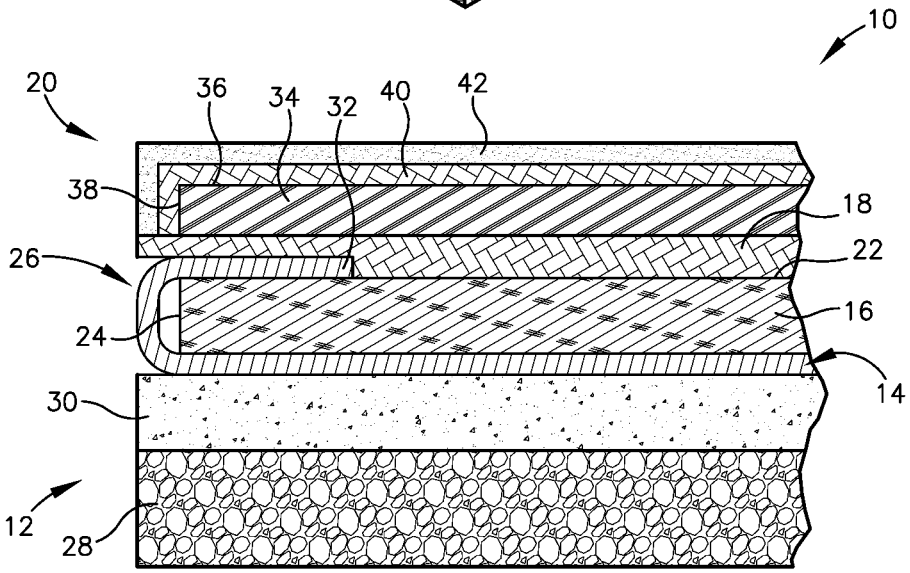
FIG. 2 is cross-sectional view of the flooring system and base of FIG. 1.

With initial reference to FIGS. 1 and 2, a flooring system 10 is shown constructed on a base 12. In the embodiment illustrated in FIGS. 1 and 2, the flooring system 10 constitutes part of a running track. However, the flooring system might alternatively be part of any one of a variety of structures, including but not limited to running tracks, tennis courts, walking trails, golf cart trails, household flooring (including basement flooring), locker room and/or bathroom flooring, swimming pools or water parks, playgrounds, and basketball courts. More generally, the flooring system might be associated with any generally horizontal, load-bearing concrete or similar surface that emits vapor or with any generally horizontal, load-bearing surface in which cracking occurs.

The flooring system 10 preferably includes a permeable barrier layer 14 disposed above the base 12, a porous underlayment 16 overlying the barrier layer 14, an impermeable sealing layer 18, and a flooring 20. Preferably, the underlayment 16 presents a top face 22 and a perimetrical side face 24, wherein the sealing layer 18 at least substantially covers the top face 22 and wherein the side face 24 includes any number of segments required to define the perimeter of the underlayment 16. Furthermore, as will be discussed in greater detail below, the barrier layer 14 preferably forms a collar 26 extending about the side face 24.

The base 12 preferably includes a base layer 28 and a slab 30. Preferably, the base layer 28 comprises rock, while the slab 30 comprises a concrete or asphalt slab. However, it is permissible for the base to comprise any one or more of a variety of materials presented in layered, non-layered, or partially layered form. These materials include but are not limited to concrete, asphalt, gravel, dirt, sand, and compacted base materials. Furthermore, the materials may be provided loose or bound by any suitable binder known in the art.

In a preferred embodiment, defects or irregularities in the base 12 may be addressed prior to assembly of the flooring system 10 through provision of a leveling course configured to accommodate such irregularities and present a smooth and level base surface. For instance, a sand and binder mixture might be spread across the base to fill cracks, pits, and low spots therein. A variety of leveling courses are permissible, including but not limited to a sand/binder mixture as discussed above; a polyurethane/rubber mixture; a latex/rubber mixture; asphalt emulsion products; loose sand, rock, asphalt, and/or gravel; or a material such as that constituting the underlayment 16. It is permissible, however, for no leveling course to be provided, with the underlayment instead contouring to the base 12 in its pre-existing form.

It is also permissible according to some aspects of the present invention for targeted improvements to be made to the base 12 prior to assembly of the flooring system 10. For instance, cracks or low spots might be filled and leveled with a rubber/rock compound, elastic fillers, concrete, asphalt, a hot pour material, rubber/polyurethane mixes, or other materials suitable for improvement or elimination the particular defect. Holes might also be drilled to create "chimneys" through which subsurface moisture can escape through the base 12.

Defects extending or projecting above the base 12 may also be removed or improved upon. For instance, high spots or nodes might be removed, and rough surfaces might be sanded.

It is noted, however, that one of the principal benefits of the illustrated embodiment is the ability to apply the flooring system 10 on the base 12 without repairing any of the base defects. That is, although the foregoing base preparation steps are within the ambit of the present invention, the flooring system 10 is still effective when applied to a base without preparation. This is primarily attributable to the barrier layer 14, as will be discussed.

In a preferred embodiment, the permeable barrier layer 14 prevents adhesion or binding between the base 12 and the underlayment 16, such that the underlayment 16 and the flooring 20 "float" relative to the base 12. In such an embodiment, the base 12 and the underlayment 16 may move independently of each other. Such an arrangement is advantageous in, among other things, decreasing propagation of flaws in the base 12 or movements of the base 12 to the underlayment 16. For instance, provision of the barrier layer 14 ensures that expansion or contraction of the base 12 due to a change in temperature will not dictate equal expansion or contraction of the underlayment 16, with the underlayment 16 instead experiencing its own expansion or contraction as appropriate. Alternatively, propagation of a crack through the base 12 and an ensuing shifting of the base 12 would not result in concurrent shifting of the underlayment 16. That is, flaws in the base 12 do not "reflect" through the flooring system 10.

Furthermore, the barrier layer 14 preferably filters dirt, dust, and other contaminants. Such contaminants may come from a variety of sources, including but not limited to flood waters or sub-base moisture. However, as will be discussed in more detail below, it is permissible according to some aspects of the present invention for the flooring system to be devoid of a barrier layer.

In a preferred embodiment, the barrier layer 14 comprises a liner sheet laid in a covering relationship with the base 12. The liner sheet may suitably be formed of a material consisting of woven fabric, nonwoven fabric, plastic, or combinations thereof. Preferably, the barrier layer 14 comprises a nonwoven geotextile. However, any one or more of a variety of at least substantially permeable materials might be used.

The barrier layer 14 might alternatively comprise lining particles spread in a covering relationship with the base 12. More particularly, the barrier layer 14 might comprise sand, rock, gravel, aggregate, dirt, plastic chips, rubber dust, or a combination thereof. A combination of the above materials in either mixed or layered form might also form the barrier layer 14.

As shown in FIGS. 1 and 2, in a first preferred embodiment, a perimetric portion of the barrier layer 14 projects outwardly from under the underlayment 16 and is formed into a permeable collar or strap 26. Preferably, the collar 26 is fixed relative to the base 12 and the top face 22 of the underlayment 16 such that an end region 32 of the collar 26 is fixed between the top face 22 and the sealing layer 18. The sealing layer 18 in this embodiment may present a first thickness as it extends over the collar 26 and present an increased thickness adjacent the end region 32 of the collar 26 so as to help maintain a level top surface of the flooring 20. Such differences in thickness are likely very small but appear exaggerated due to the schematic nature of the illustrations. It should be understood, however, that the various properties of the sealing layer and surrounding structures will dictate the actual geometry of the sealing layer and surrounding structures in a particular application.

It is also permissible according to some aspects of the present invention for the collar to be fixed relative to different layers of the flooring system 10. For instance, the collar might alternatively extend above the sealing layer so as to be positioned between the sealing layer and the flooring.

In a preferred embodiment, fixation of the collar 26 is by means of adhesives. For instance, an adhesive might be applied adjacent the edge of the base 12 to secure a portion of the barrier layer 14 to the base 12. Adhesive might also be applied to the top face 22 of the underlayment to secure the end region 32 to the top face 22. In any embodiment in which adhesive is used to secure the collar 26, however, it is preferred that the adhesive be applied in such a manner that obstruction of the side face 24 and, in turn, a resulting decrease in the venting capabilities of the underlayment 16, does not occur.

Although adhesives are a preferred fixation means, any of a variety of fixation means known in the art may be used. It is also permissible for the weight of the components of the flooring system 10 to be the sole means of securing the collar 26.

Preferably, the collar 26 extends continuously along the side face 24 of the underlayment 16. However, it is permissible for the collar to extend along only a small portion of the length of the side face 24 and/or for such extension to be discontinuous. For instance, the collar could comprise a plurality of spaced apart segments.

The collar 26 is intended to cover the side face 24 of the underlayment 16 but not seal it. That is, the collar 26 protects the side face 24 while still permitting it to breathe. Accordingly, it is permissible according to some aspects of the present invention for a non-integral collar to be provided or for multiple collars to be provided. It is also permissible for additional or alternative means of protecting the side face of the underlayment to be provided. For instance, the flooring might wrap around the side face of the underlayment, with the portion of the flooring covering the side face being at least substantially permeable to allow the side face to breathe. In such an embodiment, the remainder of the flooring could be similarly permeable or be differently configured as required by the particular application. For instance, the top surface of the flooring could be at least substantially impermeable, in contrast to the at least substantially permeable portions of the flooring covering the side face of the underlayment.

It is also permissible for the system to be entirely devoid of collars or similarly functioning structures.

In the preferred embodiment illustrated in FIGS. 1 and 2, the underlayment 16 overlies the barrier layer 14. Preferably, the underlayment 16 is flexible and pervious, with the extent of such flexibility and perviousness being selected according to the particular application. In all cases, however, it is necessary that the underlayment 16 be sufficiently pervious to allow dispersion of vapor therethrough.

The underlayment 16 preferably comprises a compound including an elastic material and inelastic particles, wherein the term "inelastic particles" as used herein simply means particulate that is relatively more rigid than the "elastic material." Preferably, the inelastic particles are denser and harder than the elastic material.

The elastic material preferably comprises rubber or polyurethane foam. However, the elastic material may alternatively comprise any one or more of a variety of materials, including but not limited to rubber pellets, granules, and beads; and particulate formed of cured chemicals with elastic characteristics, including chemicals devoid of rubber.

More generally, the elastic material may comprise any one or more of a variety of natural or man-made materials that has elastic characteristics (e.g., compressibility and expandability); can be bound together with binder material, chemical bonding, heat fusion, or other bonding techniques that retains flexibility during freeze and thaw cycles; exhibits enough strength to withstand forces such as those exerted by human traffic (e.g., runners or walkers) or small vehicle traffic (e.g., lawn mowers, golf carts, or utility vehicles); provides enough structural strength to support the flooring 20 placed thereon; and does not flood the underlayment 16 in such a manner as to at least substantially destroy its permeability and ability to disperse vapor.

The elastic material may be provided in any one or more of a variety of forms, including but not limited to circular, oval, or square granules; strands; chips; flakes; and powders. The elastic material may also be provided in a variety of sizes, thicknesses, or meshes based on the desired thickness, porosity, flexibility, and load strength of the underlayment 16.

It is also permissible for non-particulate elastic material to be provided. For instance, the elastic material might be a composition that sets or cures after mixing with the inelastic particles and that presents elastic characteristics when set or cured. In this case, the elastic material both provides the underlayment 16 with elastic characteristics and acts as a binder for the inelastic material.

The inelastic material preferably comprises washed crushed stone such as limestone chips. However, any one or more of a variety of materials may be suitable, including but not limited to stone; sand; gravel; slag; recycled concrete; geosynthetic aggregates; glass pellets or beads; plastic pellets or beads; recycled plastic aggregates; polystyrene (including recycled polystyrene); and polyurethane pellets, granules, or beads.

Preferably, the inelastic material is strong enough to support the flooring 20 and is devoid of excessive dust, oil, residue, or other contaminants that could interfere with binding of the inelastic material and the elastic material.

The size and amount of the inelastic material preferably varies based on the desired thickness, porosity, flexibility, and load strength of the underlayment 16.

The relative amounts of the elastic material and the inelastic material can likewise vary based on the desired thickness, porosity, flexibility, and load strength of the underlayment 16. For instance, an underlayment presenting a material ratio of 100% elastic material to 0% inelastic material would be highly flexible but lack both structural strength and weight. Such an underlayment would also be susceptible to tearing due to turning of small vehicles on the surface. In contrast, a high ratio of inelastic material relative to elastic material would provide an underlayment having low flexibility and thus decreased ability under certain circumstances to accommodate flaws and/or movements of the base. Therefore, the underlayment preferably comprises 25-75% by volume elastic material in most applications associated with bases comprising flawed asphalt or concrete.

If the elastic material comprises particles, the elastic material and the inelastic material are preferably combined with a binder that encapsulates the elastic material and the inelastic material to form a compound that can be formed into the underlayment 16.

The binder preferably comprises polyurethane, latex, an asphalt emulsion, or an epoxy resin in an amount that varies at least according to the binder type.

The underlayment 16 may suitably be provided with reinforcements (not shown) configured to provide additional structural strength to the underlayment 16. For instance, reinforcements such as woven wire, rebar, chicken wire, geogrids, geocells, dowels, plastic grids, and/or mesh might be provided to support a portion of the underlayment extending over a large crack in the base 12.

Application of the underlayment 16 to the barrier layer 14 is preferably by any means known in the art to be appropriate to the particular structure of the composition, including but not limited to paving, screeding, and/or tiling. Application may be effected by hand and/or using machines.

As noted previously, in the embodiment illustrated in FIGS. 1 and 2, the sealing layer 18 preferably extends at least substantially over the top face 22 of the underlayment 16. Most preferably, the sealing layer 18 completely coats and seals the top face 22. The sealing layer 18 thus preferably provides an at least substantially impermeable vapor barrier between the underlayment 16 and the flooring 20.

Preferably, the side face 24 of the underlayment 16 is left unsealed, such that vapors in the underlayment 16 may vent out of the side face 24. Such a configuration is advantageous in circumstances in which venting of vapors in the underlayment 16 is desirable. In a new construction project, for instance, provision of a side-venting underlayment 16 over a newly poured concrete base would enable construction of the flooring 20 to proceed while the concrete base continues curing for several days or even weeks, since vapors arising from the concrete base are able to disperse through the underlayment 16 and out the side face 24. A variety of other suitable applications, including those not related to accelerated construction timelines, will be readily recognized by one skilled in the art. For instance, side venting might be desirable for a running track built on an concrete base known to leak vapor through cracks formed therein.

However, as will be discussed in more detail below, it is permissible according to some embodiments of the present invention for the sealing layer to additionally cover at least part or all of the side face of the underlayment.

Preferably, the sealing layer 18 comprises a mastic material. For instance, the sealing layer may suitably comprise a mastic of polyurethane and rubber dust, wherein the mastic is 20-40% rubber dust by weight. However, the sealing layer might comprise any one or more of a variety of materials, including but not limited to a heavy, viscous polyurethane sealer made for sealing rubber mats; a latex mastic; an asphalt emulsion sealer or product; or any compatible material capable of sealing the top face 22 without significantly interfering in venting and/or dispersion of vapor through the underlayment 16.

Preferably, the thickness of the sealing layer 18 depends on the porosity of the underlayment 16, the ambient temperature, the humidity, and other weather conditions.

It is permissible for only one coat to comprise the sealing layer 18, or multiple coats may be provided as needed. It is also important for the sealing layer 18 not to permeate all the way through the underlayment 16, as this will likely destroy the desired permeability of the underlayment 16.

The flooring 20 in the embodiment illustrated in FIGS. 1 and 2 preferably comprises an elastic layer 34 including elastic material and having a top face 36 and a side surface 38; a seal layer 40 at least substantially covering the top face 36 and the side surfaces 38; and a wear coat 42 at least substantially covering the seal layer 40. In such an embodiment, the flooring 20 is impermeable on both its top and side surfaces 36 and 38 due to the seal layer 40. However, it is permissible for the seal layer to cover less of or none of the elastic layer, such that the flooring is semi-permeable or permeable, respectively, as appropriate to the particular application.

In a preferred embodiment, the flooring 20 is in the form of a running track, wherein the elastic layer 34 comprises a rubber shock pad. If desired, the flooring may comprise a mat applied to the sealed top face of the underlayment according to the principles of U.S. Pat. No. 6,090,438, the entirety of which is hereby incorporated by reference herein.

Preferably, the degree of permeability of the underlayment 16 is chosen at least in part by taking into account the susceptibility of the flooring 20 to bubbling or decomposing from the bottom up in the high moisture situations.

Optionally, the flooring may include UV protectant, be painted, be dyed, or be otherwise configured as suited to the particular application.

In a preferred embodiment, the flooring 20 is fixed relative to the underlayment 16. More particularly, the flooring 20 is preferably adhered to the sealing layer 18 overlying the top face 22 of the underlayment 16.

As is apparent from the above description, assembly of the flooring system 10 on the base 12 is preferably according to a method broadly including the steps of lining the base 12 with the barrier layer 14; applying the underlayment 16, with the barrier layer 14 serving to prevent binding of the underlayment 14 to the base 12 while permitting fluid to pass between the base 12 and the underlayment 14; sealing the top face 22 of the underlayment 14 with the sealing layer 18; and fixing the flooring 20 relative to the top face 22 of the underlayment. Furthermore, as noted previously, it is permissible according to some aspects of the present invention for the base 12 to be prepared prior to lining of the base 12 with the barrier layer 14.

As noted previously, preparation of the base 12 may include, among other things, the steps of filling any cracks in the base 12 and/or leveling any low spots in the base 12. Furthermore, vent holes may be drilled in the base 12.

The step of lining the base 12 with the barrier layer 14 may, as discussed in more detail above, include the steps of laying a fabric liner and/or spreading lining particles in a covering relationship with the base 12. Furthermore, according to some aspects of the present invention, the step preferably includes projecting a perimetrical portion of the barrier layer 14 outwardly from under the underlayment 16 to define the collar 26.

As also discussed in greater depth above, the step of applying the porous underlayment 16 preferably includes the step of mixing elastic material and inelastic material to form a compound. In certain cases, the elastic material is in the form of elastic particles, in which case the mixing step includes the step of combining the inelastic particles, the elastic particles, and a binder.

As noted previously, the step of applying the underlayment 16 may also include the step of providing reinforcement structure within the underlayment 16.

As also discussed previously, the compound at least in part constituting the underlayment 16 may suitably be paved, troweled, screed, or tiled onto the barrier layer 14 as appropriate to the specific application.

The step of sealing the top face 22 of the underlayment 16 may, as discussed previously, include the step of coating the top face 22 with a mastic material.

Finally, the step of fixing the flooring 20 relative to the top face 22 of the underlayment may include the previously-discussed steps of applying multiple flooring layers of material (e.g., the elastic layer 24, the seal layer 40, and the wear coat 42) in a covering relationship with respect to the top face 22 and/or adhering the flooring 20 relative to the top face 22.

Figure 3:
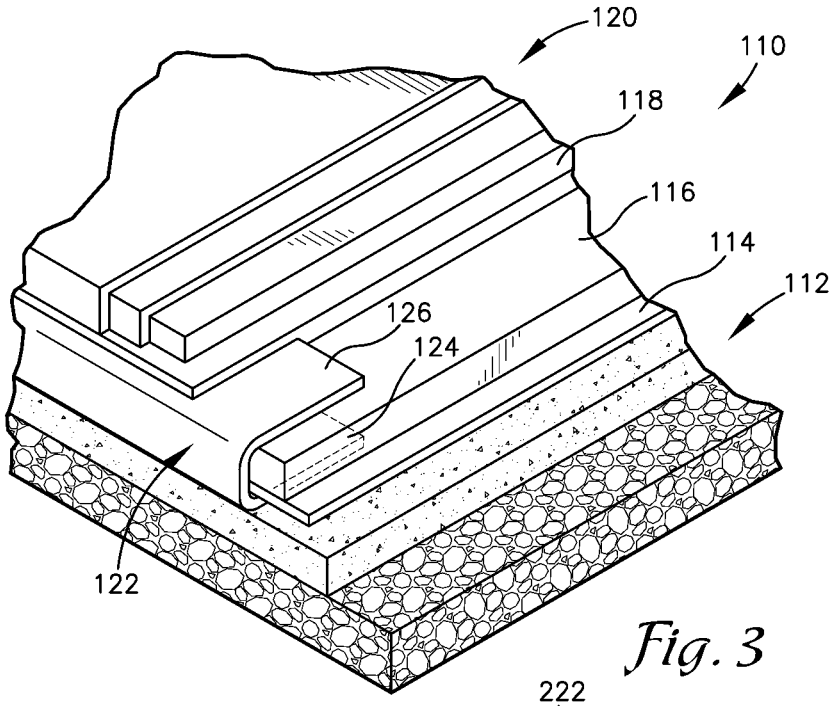
FIG. 3 is a perspective view of a flooring system and base constructed in accordance with a second preferred embodiment of the present invention, wherein the underlayment is configured to allow side venting of vapor and wherein a non-integral, permeable collar is formed over the side face of the underlayment.

A second preferred flooring system is illustrated in FIG. 3. It is initially noted that, with certain exceptions to be discussed in detail below, many of the elements of the flooring system 110 of the second embodiment are the same as or very similar to those described in detail above in relation to the flooring system 10 of the first embodiment. Therefore, for the sake of brevity and clarity, redundant descriptions and numbering will be generally avoided here. Unless otherwise specified, the detailed descriptions of the elements presented above with respect to the first embodiment should therefore be understood to apply at least generally to the second embodiment, as well.

Similarly to the flooring system 10, the flooring system 110 of the second preferred embodiment preferably includes a base 112, a barrier layer 114, an underlayment 116, a sealing layer 118, and flooring 120. However, in contrast to the integral collar 26 of the flooring system 10, the collar 122 of the flooring system 110 is independently formed. That is, the collar 122 is not integrally formed with the barrier layer 114.

Preferably, the collar 122 presents first and second margins 124 and 126, respectively, with the collar 122 being positioned relative to the base 112 such that the first margin 124 is positioned between the base 112 and the underlayment 116 and, more preferably, between the base 112 and the barrier layer 114. Such positioning relative to the barrier layer 114 ensures that the underlayment 116 binds with neither the base 112 nor the collar 122 and enables the flooring 120 and the underlayment to "float" to some extent relative to the base.

The collar 122 is further preferably positioned such that the second margin 126 is fixed between the underlayment 116 and the sealing layer 118. Most preferably, the second margin 126 is adhered to the underlayment 116 between the underlayment 116 and the sealing layer 118. However, it is permissible according to some aspects of the present invention for the second margin 126 to be non-adhered.

Preferably, the collar 122 comprises a strip of material having a width between the first and second margins 124 and 126, respectively, of approximately twelve to eighteen inches. However, it is within the scope of the present invention for the collar 122 to be formed of alternatively dimensioned material. Furthermore, it is permissible for the barrier layer 114 and the collar 122 to be constructed differently from each other. For instance, the barrier layer 114 might comprise particulate, while the collar 112 might comprise fabric.

Assembly of the flooring system 110 on the base 112 is preferably largely as discussed above with relation to the flooring system 10 and the base 12 of the first preferred embodiment. However, as is apparent from the above description, the method preferably includes an additional step of securing the permeable collar 122 over the side face of the underlayment 116 and, more particularly, fixing the first margin 124 of the collar 122 to the base 112 and fixing the second margin 126 relative to the top face 126 of the underlayment 116. As noted previously with respect to the collar 26 of the first preferred embodiment, the collar 122 is intended to cover the side face of the underlayment 116 but not seal it. That is, the collar 122 protects the side face while still permitting it to breathe.

A third preferred flooring system is illustrated in FIG. 4. It is initially noted that, with certain exceptions to be discussed in detail below, many of the elements of the flooring system 210 of the third embodiment are the same as or very similar to those described in detail above in relation to the flooring system 10 of the first embodiment and the flooring system 110 of the second embodiment. Therefore, for the sake of brevity and clarity, redundant descriptions and numbering will be generally avoided here. Unless otherwise specified, the detailed descriptions of the elements presented above with respect to the first embodiment and the second embodiment should therefore be understood to apply at least generally to the second embodiment, as well.

Similarly to the flooring system 10 and the flooring system 110, the flooring system 210 of the third preferred embodiment preferably includes a includes a base 212, an underlayment 214 having a top face 216 and a side face 218, a sealing layer 220, and flooring 222. However, the flooring system 210 is devoid of a barrier layer and an integral or non-integral collar. Rather, the underlayment 214 is adhered directly to the base 212. Preferably, this is accomplished by applying the underlayment 214 to the base 212 before it sets, such that the binding material (which, as discussed in greater detail above, may be distinct from or, alternatively, constituted by the elastic material component of the underlayment) also serves to secure the underlayment 214 to the base 212. Furthermore, the sealing layer 220 preferably extends both over the top face 216 and over the side face 218 of the underlayment 214 such that venting of vapors is prohibited. Rather, vapors simply disperse through the underlayment 214.

As will be readily ascertainable to one skilled in the art, such a configuration is particularly advantageous in a variety of applications, including those in which flooding is a significant risk. More particularly, direct adherence of the underlayment 214 combined with sealing of both the top face 216 and the side face 218 by the sealing layer 220 prevents ingress of water or other fluids into the underlayment 214 and, in turn, onto the base 212 and the underside of the flooring 222.

Although complete sealing of the side face 218 is preferable, as discussed above, it is also permissible for only part of the side face to be coated by the sealing layer.

Assembly of the flooring system 210 on the base 212 is preferably largely as discussed above with relation to the flooring system 10 and the base 12 of the first preferred embodiment and the flooring system 110 and the base 112 of the second preferred embodiment. However, as is apparent from the above description, the method preferably excludes steps associated with the barrier layers and collars and includes an additional step of sealing the side face of the underlayment 214 with the sealing layer 220.

A fourth preferred flooring system is illustrated in FIG. 5. It is initially noted that, with certain exceptions to be discussed in detail below, many of the elements of the flooring system 310 of the fourth embodiment are the same as or very similar to those described in detail above in relation to the flooring systems 10, 110, and 210 of the first, second, and third embodiments, respectively. Therefore, for the sake of brevity and clarity, redundant descriptions and numbering will be generally avoided here. Unless otherwise specified, the detailed descriptions of the elements presented above with respect to the first, second, and third embodiments should therefore be understood to apply at least generally to the fourth embodiment, as well.

Similarly to the flooring systems 10, 110, and 210, the flooring system 310 of the third preferred embodiment preferably includes a includes a base (not shown), an underlayment 312 having a top face 314, a sealing layer 316, and flooring 318.

However, the underlayment 312 preferably comprises a plurality of interconnected tiles 320. It is within the scope of the present invention, however, for the underlayment to alternatively comprise a plurality of non-interconnected tiles or to be at least substantially non-continuous. Preferably, in non-continuous or tiled embodiments such as that illustrated in FIG. 5, the underlayment 312 is not applied wet and then permitted to set. Instead, the underlayment 312 is formed and set into individual tiles or segments that are then placed on the base.

The sealing layer 316 preferably comprises a first coat 322 and second coat 324. The first coat 322 preferably comprises a polyurethane seal coat, while the second coat 324 preferably comprises a self-leveling polyurethane flood coat. However, a variety of coatings are permissible.

The flooring 20 preferably comprises household flooring such as wood, although a variety of other flooring types, including but not limited to vinyl or laminate flooring, are permissible.

Assembly of the flooring system 310 is preferably largely as discussed above with relation to the flooring system 210 of the third preferred embodiment. However, as is apparent from the above description, the method preferably excludes steps associated with sealing of the side face of the underlayment 312 and includes additional sub-steps associated with sealing the top face 314 of the underlayment 312 due to the multi-layered construction of the sealing layer 314. More particularly, the method preferably includes the steps of providing the first coat 322 on the top face 314 of the underlayment 312 and separately providing the second coat 324 on top of the first coat 322 to form the sealing layer 314.

Although the above description presents features of preferred embodiments of the present invention, other preferred embodiments may also be created in keeping with the principles of the invention. Furthermore, as noted previously, these other preferred embodiments may in some instances be realized through a combination of features compatible for use together despite having been presented independently as part of separate embodiments in the above description.

The preferred forms of the invention described above are to be used as illustration only and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention set forth in the following claims.

What is claimed is:

1. A method of constructing a flooring system on a base, said construction method comprising the steps of:

(a) lining the base with a permeable barrier layer;

(b) applying a porous underlayment on the barrier layer, with the barrier layer serving to prevent binding of the underlayment to the base while permitting fluid to pass between the base and underlayment;

(c) sealing the top face of the underlayment with a seal; and (d) fixing a flooring relative to the top face of the underlayment, prior to step (a), preparing the base, drilling vent holes within the base.

2. A method of constructing a flooring system on a base, said construction method comprising the steps of:

(a) lining the base with a permeable barrier layer;

(b) applying a porous underlayment on the barrier layer, with the barrier layer serving to prevent binding of the underlayment to the base while permitting fluid to pass between the base and underlayment, and the underlayment serving to disperse and/or direct any vapor passing thereto;

(c) sealing the top face of the underlayment with a seal so as to create at an least substantially impermeable vapor barrier at the top face of the underlayment; and (d) fixing a flooring relative to the top face of the underlayment, step (a) including the step of laying a liner sheet in a covering relationship with the base.

3. A method of constructing a flooring system on a base, said construction method comprising the steps of:

(a) lining the base with a permeable barrier layer;

(b) applying a porous underlayment on the barrier layer, with the barrier layer serving to prevent binding of the underlayment to the base while permitting fluid to pass between the base and underlayment, and the underlayment serving to disperse and/or direct any vapor passing thereto;

(c) sealing the top face of the underlayment with a seal so as to create at an least substantially impermeable vapor barrier at the top face of the underlayment; and (d) fixing a flooring relative to the top face of the underlayment, step (a) including the step of spreading lining particles in a covering relationship with the base.

4. A method of constructing a flooring system on a base, said construction method comprising the steps of:

(a) lining the base with a permeable barrier layer;

(b) applying a porous underlayment on the barrier layer, with the barrier layer serving to prevent binding of the underlayment to the base while permitting fluid to pass between the base and underlayment, and the underlayment serving to disperse and/or direct any vapor passing thereto;

(c) sealing the top face of the underlayment with a seal so as to create at an least substantially impermeable vapor barrier at the top face of the underlayment; and (d) fixing a flooring relative to the top face of the underlayment, step (b) including the step of mixing an elastic material and inelastic particles to form a compound.

5. The construction method as claimed in claim 4, said mixing step including the step of combining the inelastic particles, the elastic material, which is in the form of elastic particles, and a binder.

6. The construction method as claimed in claim 4, step (b) including the step of paving and/or tiling the compound on the barrier layer.

7. The construction method as claimed in claim 4, step (b) including the step of providing reinforcement structure within the underlayment.

8. The construction method as claimed in claim 4, step (c) including the step of sealing the side face of the underlayment.

9. The construction method as claimed in claim 4, step (c) including the step of coating the top face with a mastic material.

10. The construction method as claimed in claim 4, step (d) including the step of adhering the flooring relative to the top face.

11. The construction method as claimed in claim 10, step (d) including the steps of applying multiple flooring layers of material in a covering relationship with respect to the top face.

12. The construction method as claimed in claim 4; and (e) securing a permeable collar over the side face of the underlayment.

13. A method of constructing a flooring system on a base, said construction method comprising the steps of:

(a) lining the base with a permeable barrier layer;

(b) applying a porous underlayment on the barrier layer, with the barrier layer serving to prevent binding of the underlayment to the base while permitting fluid to pass between the base and underlayment;

(c) sealing the top face of the underlayment with a seal;

(d) fixing a flooring relative to the top face of the underlayment; and (e) securing a permeable collar over the side face of the underlayment, step (e) including the steps of fixing a first margin of the collar to the base and fixing a second margin of the collar relative to the top face of the underlayment.

14. The construction method as claimed in claim 4, prior to step (a), preparing the base.

15. The construction method as claimed in claim 14, said preparing step including the steps of filling any cracks in the base and/or leveling any low spots in the base.

16. A method of constructing a flooring system on a base, said construction method comprising the steps of:

(a) lining the base with a permeable barrier layer;

(b) applying underlayment on the barrier layer, with the barrier layer serving to prevent binding of the underlayment to the base while permitting fluid to pass between the base and underlayment, and the underlayment serving to disperse and/or direct any vapor passing thereto;

(c) sealing the top face of the underlayment with a seal so as to create at an least substantially impermeable vapor barrier at the top face of the underlayment; and (d) fixing a flooring relative to the top face of the underlayment, prior to step (a), preparing the base, drilling vent holes within the base.

17. A method of constructing a flooring system on a base, said construction method comprising the steps of:

(a) lining the base with a permeable barrier layer;

(b) applying a porous underlayment on the barrier layer, with the barrier layer serving to prevent binding of the underlayment to the base while permitting fluid to pass between the base and underlayment, and the underlayment serving to disperse and/or direct any vapor passing thereto;

(c) sealing the top face of the underlayment with a seal so as to create at an least substantially impermeable vapor barrier at the top face of the underlayment; and (d) fixing a flooring relative to the top face of the underlayment, (e) securing a permeable collar over the side face of the underlayment, step (e) including the steps of fixing a first margin of the collar to the base and fixing a second margin of the collar relative to the top face of the underlayment.

* * * * *